US011400002B2

(12) United States Patent
Lewis

(10) Patent No.: US 11,400,002 B2
(45) Date of Patent: Aug. 2, 2022

(54) PATIENT LIFTER HAVING INTERLOCKING DESIGN WITH INTRAOPERATIVE CONTROLLED TEMPERATURE AIR DELIVERY SYSTEM

(71) Applicant: PGL 2020 SLAT, Bethesda, MD (US)

(72) Inventor: Randall J. Lewis, Bethesda, MD (US)

(73) Assignee: PGL 2020 SLAT, Bethesda, MD (US)

( * ) Notice: Subject to any disclaimer, the term of this patent is extended or adjusted under 35 U.S.C. 154(b) by 50 days.

(21) Appl. No.: 16/868,241

(22) Filed: May 6, 2020

(65) Prior Publication Data

US 2021/0346222 A1 Nov. 11, 2021

(51) Int. Cl.
*A61G 7/10* (2006.01)

(52) U.S. Cl.
CPC ..... *A61G 7/1021* (2013.01); *A61G 7/1028* (2013.01); *A61G 7/1038* (2013.01); *A61G 7/1074* (2013.01); *A61G 2200/32* (2013.01)

(58) Field of Classification Search
CPC .. A61G 7/1021; A61G 7/1028; A61G 7/1038; A61G 7/1074; A61G 2200/32; A61G 7/05776
See application file for complete search history.

(56) References Cited

U.S. PATENT DOCUMENTS 3,297,023 A * 1/1967 Foley ..... A61H 9/0078 601/148
3,449,776 A 6/1969 Brock
(Continued)

FOREIGN PATENT DOCUMENTS

JP 2002000669 A 1/2002

OTHER PUBLICATIONS

AirMatt—Patent Transfer System at web location: https://midmed.com.au/collections/mattresses May 2020.
(Continued)

*Primary Examiner* — Peter M. Cuomo
*Assistant Examiner* — Adam C Ortiz
(74) *Attorney, Agent, or Firm* — Ernest D. Buff & Associates, LLC; Ernest D. Buff

(57) ABSTRACT

A combination patient-transfer air-inflated pad and intraoperative heater device has first and second interlocking chambers laterally fused together. The air-inflated pad has a top surface and a bottom surface formed by way of the first and second interlocking chambers. The first interlocking chamber is formed as a comb-type structure having a main spine with two or more prongs alternately separated by valleys. The second interlocking chamber is a mirror comb-type structure to the first interlocking chamber. The device is fabricated from two thin layers of plastic material, selectively configured and fused. With this construction, the bulk of the device, as well as the cost of manufacture, are reduced. The device is affordable for single use, obviating the difficulty and possible incompleteness of sterilization between uses. The first interlocking chamber has an inlet appointed to be supplied with regulated, controlled low pressure and controlled temperature heated or cooled air. The second interlocking chamber has a plurality of air venting apertures in said bottom surface of said air-inflated pad. The second interlocking chamber has an inlet appointed to be supplied with ambient air at a regulated, controlled pressure to facilitate lifting and lateral displacement during patient transfer. The device may be easily re-employed when the patient is transferred from one location to another and may function as an alternating pressure mattress if needed.

14 Claims, 4 Drawing Sheets

(56) References Cited

U.S. PATENT DOCUMENTS

| | | | | |
|---|---|---|---|---|
| 3,644,950 | A | 2/1972 | Lindsay, Jr. | |
| 3,667,073 | A | 6/1972 | Renfroe | |
| 3,678,520 | A * | 7/1972 | Evans | A61G 7/05776 5/713 |
| 3,740,777 | A | 6/1973 | Dee | |
| 3,757,366 | A | 9/1973 | Sacher | |
| 3,778,851 | A | 12/1973 | Howorth | |
| 3,822,425 | A | 7/1974 | Scales | |
| 4,279,044 | A | 7/1981 | Douglas | |
| 4,391,009 | A * | 7/1983 | Schild | A61G 7/05784 297/180.11 |
| 5,022,110 | A | 6/1991 | Stroh | |
| 5,103,518 | A * | 4/1992 | Gilroy | A61G 7/05776 5/713 |
| 5,109,560 | A | 5/1992 | Uetake | |
| 5,113,539 | A | 5/1992 | Strell | |
| 5,168,589 | A | 12/1992 | Stroh et al. | |
| 5,249,318 | A | 10/1993 | Leadsman | |
| 5,396,671 | A * | 3/1995 | Stacy | A61G 7/05776 297/DIG. 3 |
| 5,416,935 | A | 5/1995 | Nieh | |
| 5,483,709 | A | 1/1996 | Foster et al. | |
| 5,561,873 | A | 10/1996 | Weedling | |
| 5,590,428 | A | 1/1997 | Roter | |
| 5,652,987 | A | 8/1997 | Fujita | |
| 5,781,943 | A | 7/1998 | Moenning et al. | |
| 6,065,166 | A | 5/2000 | Sharrock et al. | |
| 6,073,291 | A | 6/2000 | Davis | |
| 6,546,576 | B1 | 4/2003 | Lin | |
| D474,061 | S * | 5/2003 | Cook | D6/604 |
| 6,618,884 | B1 | 9/2003 | Wu | |
| 7,090,692 | B1 | 8/2006 | Augustine et al. | |
| 7,114,204 | B2 | 10/2006 | Patrick | |
| 7,278,179 | B2 | 10/2007 | Schneider | |
| 7,565,709 | B2 | 7/2009 | Davis | |
| 7,627,910 | B2 | 12/2009 | Davis | |
| 7,735,164 | B1 | 6/2010 | Patrick | |
| 7,761,945 | B2 * | 7/2010 | Butler | A61G 7/05784 5/713 |
| 7,914,611 | B2 | 3/2011 | Vrzaiik et al. | |
| 8,555,440 | B2 | 10/2013 | Lewis | |
| 8,656,539 | B1 | 2/2014 | Boyd | |
| 9,381,127 | B2 | 7/2016 | Scholz et al. | |
| 10,092,470 | B2 | 10/2018 | Lewis | |
| 2005/0097674 | A1 * | 5/2005 | Mileti | A61G 7/05784 5/710 |
| 2006/0253976 | A1 | 11/2006 | Weedling et al. | |
| 2007/0006385 | A1 | 1/2007 | Davis | |
| 2008/0000030 | A1 | 1/2008 | Wang | |
| 2009/0320211 | A1 | 12/2009 | Lau | |

OTHER PUBLICATIONS

AirPal—Patient Air Lift at web location: http://www.airpal.com/manual1.pdf discloses a patient transfer system. Jan. 2020.

Hover Tech—HOVERMATT Web location http://www.hovermatt.com The brochure is available at http://www.hovermatt.com/media_pdf/HoverMatt_Brochure.pdf, Jan. 2020.

* cited by examiner

PATIENT LIFTER HAVING INTERLOCKING DESIGN WITH INTRAOPERATIVE CONTROLLED TEMPERATURE AIR DELIVERY SYSTEM

1. FIELD OF THE INVENTION

The present invention relates to a patient transfer system, and more particularly to a patient lifter device that includes intraoperative controlled heated or cooled air delivery that surrounds a patient resting thereon, maintaining desired body temperature during surgery.

2. DESCRIPTION OF THE PRIOR ART

Lateral transfer of patients is often problematic. This is especially the case in operating rooms. Back injuries, as well as a plethora of other injuries, are oftentimes encountered by the person/persons lifting the patient, and generally make up the most common work-related injury to hospital personnel. In addition, during lateral movement the patient is at risk of being dropped, falling or being placed in a way that can result in injury. Air lifters, which are similar to a hovercraft, have been provided to help transfer patients. On many occasions, temperature regulation of patients is required to provide for comfort and to maintain proper body temperature. Various devices have been provided in the way of heating/cooling mattresses for maintaining patient temperature.

Examples of patient support systems and/or transporters include:

U.S. Pat. No. 3,449,776 to Brock discloses a collapsible telescoping stretcher including a plurality of flexible straps attached to the stretcher adapted to tie down the legs and torso of the patient to the stretcher. U.S. Pat. No. 3,644,950 to Lindsay et al. discloses a patient support system. Included with the system is a bed for supporting and treating a hospital patient. U.S. Pat. No. 3,667,073 to Renfroe discloses a patient transporter. U.S. Pat. No. 3,740,777 to Dee discloses a bed support. U.S. Pat. No. 3,757,366 to Sacher discloses a cushion for preventing and alleviating bedsores. U.S. Pat. No. 3,778,851 to Howorth discloses a mattress for use in treating a patient who has undergone extensive surgery or who has been severely burned. U.S. Pat. No. 3,822,425 to Scales discloses an inflatable support appliance. U.S. Pat. No. 4,279,044 to Douglas discloses a fluid support system for a medical patient. U.S. Pat. No. 4,391,009 to Schild et al. discloses a ventilated body support. U.S. Pat. No. 5,022,110 to Stroh discloses a low air loss mattress. U.S. Pat. No. 5,109,560 to Uetake discloses a ventilated air mattress with alternately inflatable air cells having communicated upper and lower air chambers. U.S. Pat. No. 5,113,539 to Strell discloses a body supporting device such as a mattress, box spring, cushion or car seat having an inner coil spring structure. U.S. Pat. No. 5,168,589 to Stroh et al. discloses a pressure reduction air mattress and overlay. U.S. Pat. No. 5,249,318 to Loadsman discloses an air cushion support. U.S. Pat. No. 5,416,935 to Nieh discloses a surface air conditioning device including a plurality of passages through a support surface which overlies a closed volume in which temperature conditioned air is supplied; each passage is provided with a pressure-actuated flow control valve which is normally closed to prevent loss of conditioned air through the associated passage. U.S. Pat. No. 5,483,709 to Foster et al. discloses a low air loss mattress with rigid internal bladder and lower air pallet. It is not disposable and is primarily a thick mattress. U.S. Pat. No. 5,561,873 to Weedling discloses an air chamber-type patient mover air pallet with multiple control features. U.S. Pat. No. 5,590,428 to Roter discloses an air pressurized person supporting device with ventilation. U.S. Pat. No. 5,652,987 to Fujita discloses a decubitus ulcer prevention device. U.S. Pat. No. 5,781,943 to Moenning et al. discloses a medical table and method for moving a patient from a first position to a second position. This medical table includes a base. U.S. Pat. No. 6,073,291 to Davis discloses an improved inflatable medical patient transfer apparatus having a combination of transverse partition members and a raised perimeter section that reduces deleterious ballooning and uneven inflation as well as quick emergency deflation and provides additional security for a patient supported upon such transfer apparatus. U.S. Pat. No. 6,065,166 to Sharrock discloses a support cushion for a person in a lateral decubitus position, comprising a base, two lateral structural supports, and a central concavity. U.S. Pat. No. 6,546,576 to Lin discloses the structure of a ventilated mattress with a cooling and warming effect. U.S. Pat. No. 7,090,692 to Augustine et al. discloses a thermal blanket. The blanket lies above the patient, rather than below. U.S. Pat. No. 7,114,204 to Patrick discloses a method and apparatus for transferring patients. U.S. Pat. No. 7,627,910 to Davis discloses a transfer mattress including an upper mattress having three longitudinally oriented plenums and three separate inlet/outlet valves that are each arranged in airflow communication with their respective plenum. U.S. Pat. No. 7,278,179 to Schneider describes an inflatable mat with vent structures controlled by heat sensors. U.S. Pat. No. 7,565,709 to Davis discloses a double-chambered transfer mattress capable of partial deflation, and which includes a top inflatable mattress and a bottom inflatable mattress that are separated by a common wall from one another. U.S. Pat. No. 7,735,164 to Patrick discloses a disposable patient transfer mattress, including a rectangular top sheet, a rectangular bottom sheet, internal baffles, and a receptacle configured to receive a connector for supplying air to inflate the mattress. U.S. Pat. No. 7,914,611 to Vrzalik discloses a support system including a multi-layer cover sheet with a number of layers. U.S. Pat. Nos. 8,555,440 and 9,381,127 to Lewis disclose a dual function patient lifter with temperature control. The lifter is a three-layer construct, formed into a top compartment and a bottom compartment separated by a membrane. U.S. Pub. Pat. App. No. 2008/0000030 to Wang discloses an inflatable mattress designed for more than one body to be supported on its surface. U.S. Pub. Pat. App. No. 2009/0320211 to Lau discloses an inflatable bed assembly having a plurality of inflatable cushion cells disposed on the top of the inflatable bed. Foreign Patent Publication No. JP2002000669 to Masato et al. discloses a bed and chair for nursing and care. The bed or chair is lifted upwards by pumping air into an air pad. "AirMatt—Patient Transfer System" at web location http://www.midmed.com.au/index.php?module=pagesetter&func=viewpub&tid=2&pid=55& header=1 discloses Airmatt|Lateral Air Transfer System. "AirPal-Patient Air Lift" at web location http://www.airpal.com/manual1.pdf discloses a patient transfer system. "Hover Tech International-HoverMatt" is found at web location http://www.hovermatt.com/. The brochure is available at http://www.hovermatt.com/media_pdf/HoverMatt_ Brochure.pdf.

In general, the temperature control and alternating pressure devices previously disclosed are composed of heavy mattresses. Their thick supporting structures are designed for longer-term or continuous usage, and not for the short term, transient application of patient transfer. Except for Lewis, none of the devices provides an inter-operative pad that delivers clean air to lift the patient. Most of the devices are not practical for single usage and disposal.

SUMMARY OF THE INVENTION

The present invention provides a system and method to lift and laterally transfer a patient that also delivers warm air or employs a heated surface that directly transfers heat, maintaining body temperature during surgery. The lifter/transfer portion of the device (second interlocking chamber) is inflated to achieve transfer of the patient and is otherwise collapsed; it is not a static mattress. The ambient air second interlocking chamber of the patient lifter is inflatable for use to transfer the patient to a different support structure, such as a mattress, stretcher, or other surface.

The system of the present invention provides a patient lifter with heating and/or cooling, comprising an air-inflated pad having a top surface and a bottom surface formed by way of a first interlocking chamber and a second interlocking chamber laterally fused together. The first interlocking chamber is formed as a comb-type structure having a main spine with two or more prongs alternately separated by valleys. The second interlocking chamber is formed as a mirror comb-type structure to the comb-type structure of the first interlocking chamber with two or more opposing prongs alternatively separated by opposing valleys. The first interlocking chamber includes an inlet appointed to be supplied with a regulated, controlled low pressure and controlled temperature heated or cooled air. The second interlocking chamber has a plurality of air venting apertures located in the bottom surface of the air-inflated pad. An inlet provided in the second interlocking chamber is appointed to be supplied with ambient air at a regulated, controlled pressure to facilitate lifting and lateral displacement during patient transfer. The heated air or cooled air is circulated through the first interlocking chamber, and formation of an air cushion from the second interlocking chamber facilitates lateral translation on a flat or irregular surface and reduces stress on both patient and hospital personnel.

Preferably, each of said first and said second interlocking chambers is laterally fused so that each of said first and said second interlocking chambers makes up a portion of said top and said bottom surface of said air-inflated pad. Preferably, the subject patient lifter includes handles. The patient lifter is preferably constructed of two-layer polyvinyl chloride (PVC), polyethylene, or other plastic material.

In one embodiment, the first interlocking chamber includes apertures or holes for air escape. In another embodiment, the first interlocking chamber does not include any apertures or holes for air escape on said top surface of said air-inflated pad. The second interlocking chamber preferably substantially entirely laterally surrounds said first interlocking chamber. Preferably each interlocking chamber is a single continuous chamber free from springs or barriers therein.

The patient lifter may comprise a single blower/motor with variable (high/low) air output and a heater that can be switched on or off, wherein high pressure/volume air flow without heat is appointed to be delivered to said second interlocking chamber for transfer function and low pressure with heated (or potentially cooled) air in said first interlocking chamber being appointed for either distributing warm air or radiating heat to maintain correct patient temperature, depending on whether or not the chamber has apertures or holes for air escape. Preferably, the second interlocking chamber is a single continuous chamber free from springs or barriers therein. The patient lifter may be fabricated from a thin, flexible disposable material for single use.

Significant advantages are incorporated into the design of the patient lifter. Configured as a single layer construct, the patient lifter comprises two independent interlocking compartments produced by controlled welding of two plastic layers. This interlocking design saves as much as 50% of the material needed to fabricate the device. The resulting lifter is much more compact. Storage is facilitated and manufacturing costs are significantly reduced. The lifter can readily be employed as an alternating pressure mattress to facilitate transfer of the patient to a different support structure, such as a mattress, stretcher, or other surface.

BRIEF DESCRIPTION OF DRAWINGS

The invention will be more fully understood and further advantages will become apparent when reference is had to the following detailed description of the preferred embodiments and the accompanying drawings, in which.

DESCRIPTION OF THE PREFERRED EMBODIMENTS

The subject patient lifter/heater provides a two layer construction with a plurality of holes for air escape on the bottom surface to lift the mattress/pad, and a top surface with holes that permit heated air passing from the surface to warm a patient. The upper heating surface or top surface, alternatively without air escape holes, permits the device to function as a closed circuit warmer. Additionally, the patient lifter/heater may be detachably connected to an antimicrobial chamber to permit sterilizing the interior of the blower and air conduits of the patient lifter/heater.

Patients are oftentimes required to be transported from a hospital bed to an X-ray, CT or MRI facility for laboratory tests. A patient may also be required to be transported from the hospital bed or stretcher to an operating table. Patients often have painful limbs or fractures, and any movement of the patient may result in extreme discomfort. Further, patients with high body weight are generally more difficult to move, and the lateral transfer of a patient can injure the patient and cause back injuries to the hospital staff. Recent development of airlift mattresses, as for example, those marketed by AirMatt, AirPal or HoverMatt have produced air mattresses with air cushion-forming apertures thereunder. These air-cushion forming apertures enable a patient positioned on the mattress to be laterally displaced on or off a flat or irregular surface. The patient may be laterally moved from a hospital bed to a stretcher, or from a stretcher to an x-ray table or an operating table. Generally, these devices are heavy and not disposable. Cleaning of the devices between patient usage is required, and may be imperfect. In addition, these airlift mattresses do not surround the patient with controlled temperature surface heat. As a result, the patient requires the use of another device to maintain body temperature during anesthesia.

When heated air is provided in the upper chamber through apertures or holes, the patient is warmed and temperature maintained during surgery. If the subject patient lifter includes an upper chamber without holes, heated air is introduced into the patient lifter, forming a closed circuit and patient temperature is maintained by direct transfer of heat from the surface of the warmed chamber. Ambient air is supplied to the lower chamber by high pressure to create the air cushion during transfer. As the air flow in the lower compartment is not obstructed, it also reduces the power that the pump must deliver to achieve the high flow that is necessary when the patient is being lifted and transported.

Figure 1A:
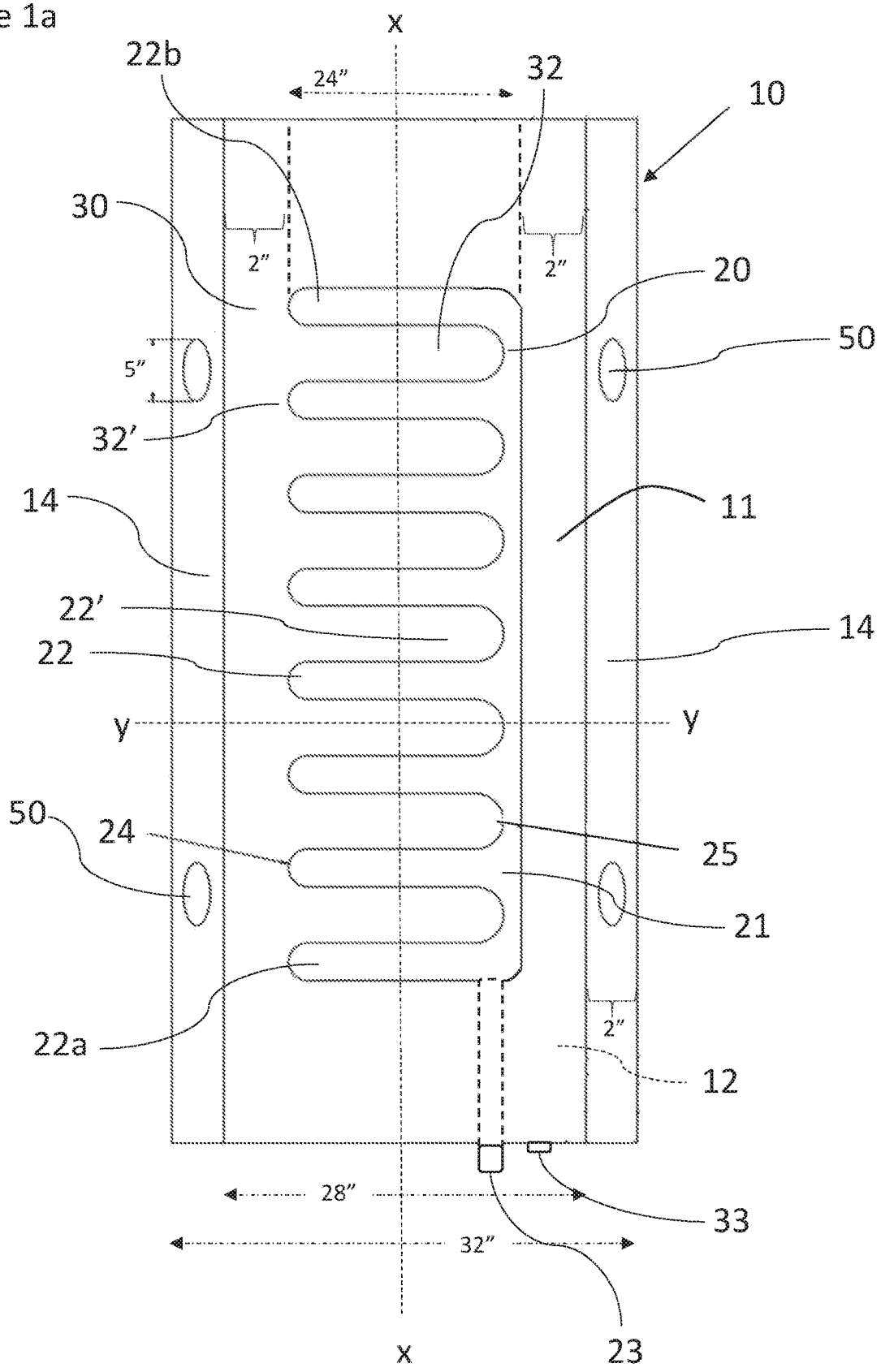
FIG. 1*a* is a top view depicting a first embodiment of the subject patient lifter/heater.
Figure 1B:
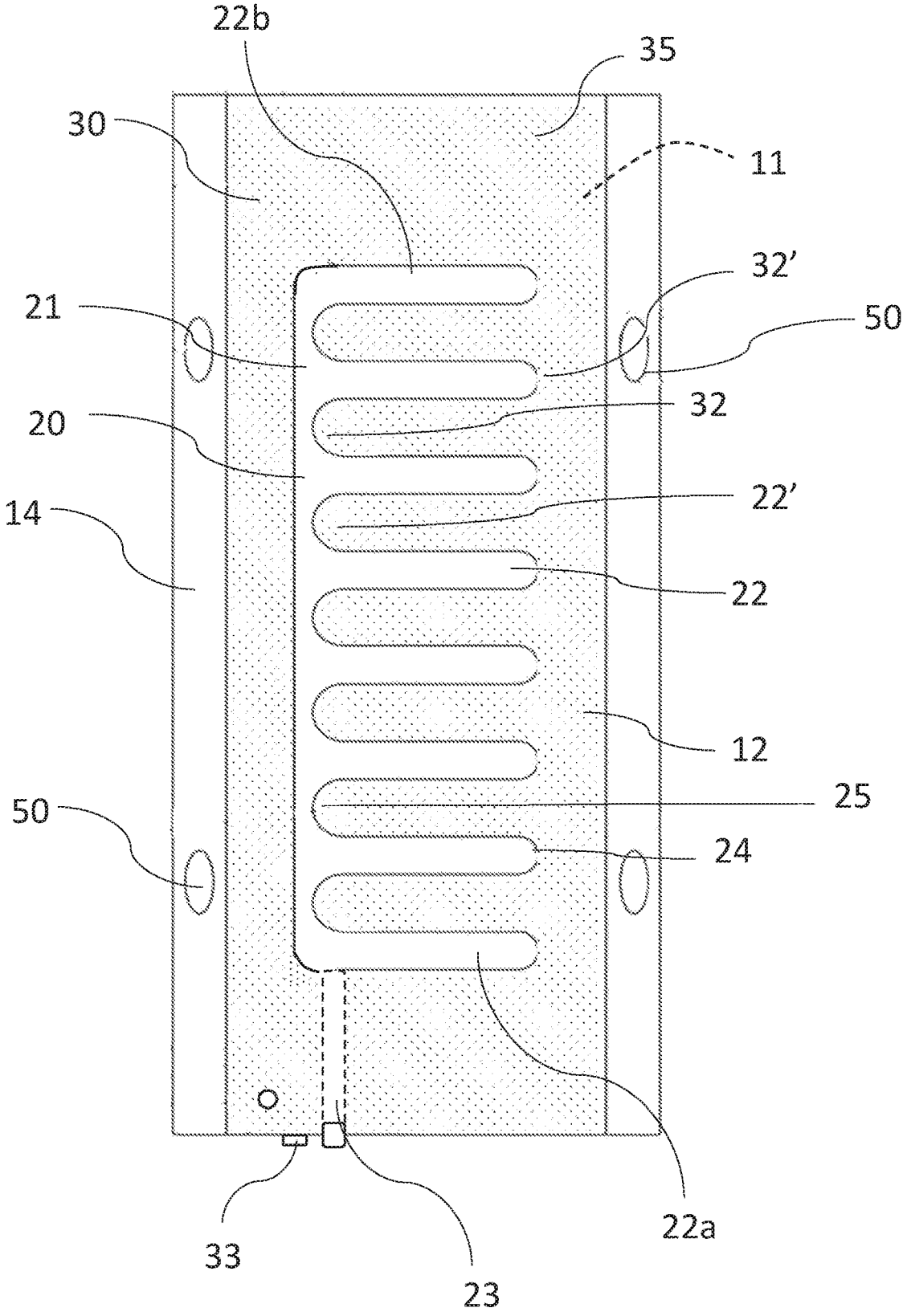
FIG. 1*b* is a bottom view depicting the patient lifter/heater of FIG. 1*a;*
Figure 1C:
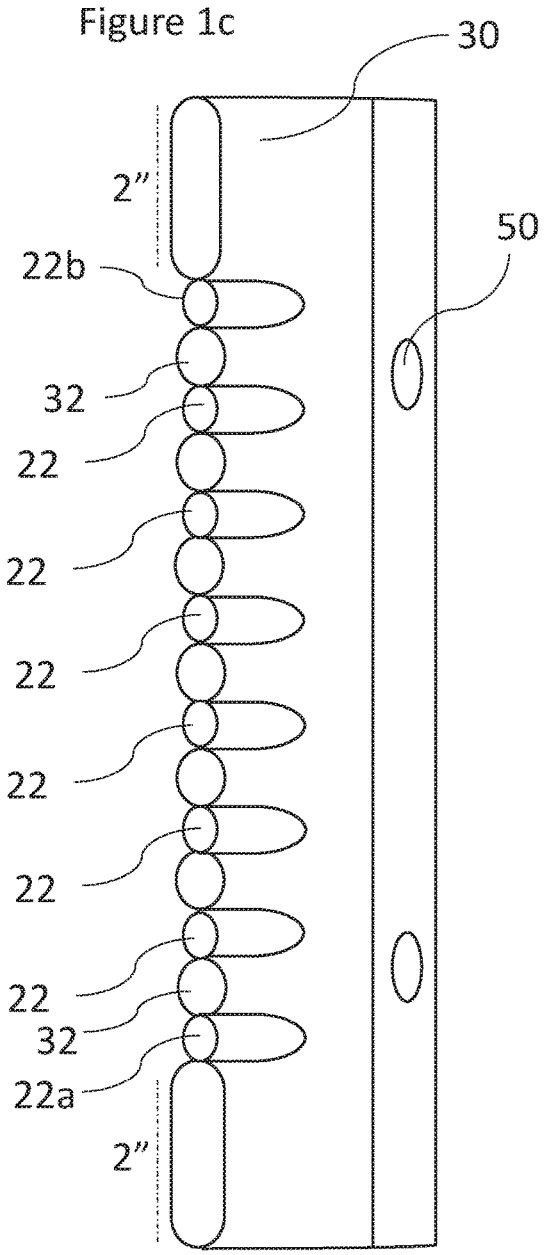
FIG. 1*c* is a cross-sectional view taken along line x-x.
Figure 1D:
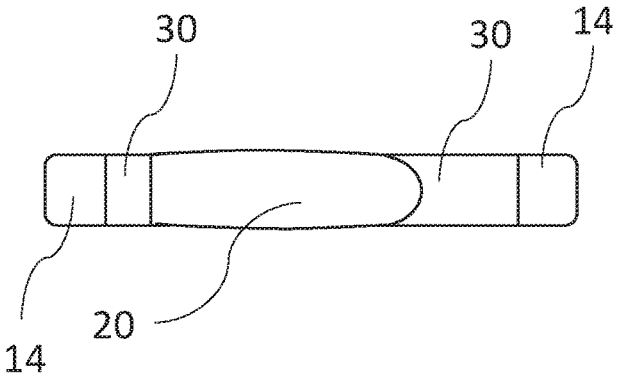
FIG. 1*d* is a cross-sectional view taken along line z-z.

FIGS. 1*a*-1*d* illustrate a first embodiment of the subject patient lifter/heater. FIG. 1*a* illustrates a top view. FIG. 1*b* illustrates a bottom view. FIG. 1*c* illustrates a cross-sectional view taken along line x-x. FIG. 1*d* illustrates a cross-sectional view taken along line z-z. Mattress or pad 10 is generally composed as a thin flexible matt constructed having a top surface 11 and a bottom surface 12 formed by way of first and second interlocking chambers 20 and 30. First and second interlocking chambers 20 and 30 are separated from the other by a membrane, formed when two layers of PVC, polyethylene or other plastic material are selectively fused together. Preferably, handles 50 are provided as apertures on both sides 14 of the mattress which are also formed by fusion of the two layers.

First interlocking chamber 20 is formed as a comb-type structure having main spine 21 with a row of prongs 22 separated by valleys 22' forming a continuous chamber. Prongs 22 are formed as fingers and include a proximal prong 22*a* and a distal prong 22*b* separated by a plurality of prongs 22*a*+n. Preferably, proximal and distal prongs, 22*a* and 22*b*, are spaced from the edge of the pad or matt 10 a distance of about 2" to 6" so that the first interlocking chamber 20 does not extend beneath a patient's head or foot.

An inlet 23 is provided proximal to proximal prong 22*a* for heated air entry into first interlocking chamber 20, which exits from the chamber through apertures or holes and circulates around the patient to maintain body temperature. Alternatively, first interlocking chamber 20 does not include any apertures or holes for air escape but instead has a smooth, uninterrupted top surface and the patient's body temperature is maintained by direct transfer of heat from the warmed top surface. Each prong 22 includes an arched convex end 24 linearly connected to an arched concave end 25. Preferably, prongs 22 have a linear length of about 20 to 24 inches.

Second interlocking chamber 30 is formed preferably entirely surrounding first interlocking chamber 20 and includes a mirror comb-type structure having oppositely arranged prongs 32 separated by valleys 32' matingly laterally fused, side by side and not overlapping, with first interlocking chamber 20. Second interlocking chamber 30 includes an inlet 33 for passing ambient air into the chamber 30 from a blower unit. As best illustrated in FIG. 1*b*, second interlocking chamber 30 includes a plurality of holes or apertures 35 located on the bottom surface 12 for providing air release through the holes or apertures 35 in airlifting the pad 10 for patient lifting.

The first interlocking chamber receives low pressure compressed heated (or cooled) air supplied to the first interlocking chamber 20 through a hose attached to inlet 23 by way of mating attachment means for attachment to a heater/blower unit, and/or an anti-microbial mist unit for sterilization of the system 10.

Apertures 50 function as handles to facilitate lateral transfer when the second interlocking chamber 30 is pressurized by ambient compressed air at a preselected regulated pressure to inlet aperture 33 through a hose attached to the inlet aperture 33 and, by way of a mating attachment means, to a blower.

The bottom surface 12 of the second interlocking chamber 30 is provided with a plurality of apertures 35 through which the regulated pressure compressed air leaks. When transfer or lifting of the patient is not required, air delivery to the second interlocking chamber 30 is generally low or off. When it is time to initiate lifting or transfer of the patient, air delivery to the second interlocking chamber 30 is increased or turned on so that regulated pressure of compressed air is delivered into the second interlocking chamber 30 and flows from the apertures 35, functioning to create an air pocket under the bottom surface 12 of the pad and facilitating lifting or transfer of the patient and pad onto another surface. Regulated compressed air pressure is increased to a high value, and air leaks through the apertures 35 creating an air cushion between the second interlocking chamber 30 of the pad and an underlying flat or uneven surface, such as a bed, stretcher or an operating table. This air cushion essentially levitates the pad with the patient slightly above the flat or uneven surface, whereby the patient may be laterally displaced with minimal effort. Using this procedure, the patient is easily displaced laterally with minimal effort for example, from a bed to a stretcher or a stretcher to an operating table or any combination thereof. When the patient is moved to a desired location, the compressed air pressure may be brought to substantially zero or very low so that the bottom chamber is substantially flat or un-inflated. Preferably, both the first and second interlocking chambers 20 and 30 have shallow depths so that less air is needed to warm first interlocking chamber 20, and less air is needed to initiate air leakage through the bottom apertures 35 of second interlocking chamber 30 when creating the air cushion and the air cushion is created at a more rapid rate.

This air cushion essentially levitates the pad with the patient slightly above the flat or uneven surface, whereby the patient may be laterally displaced with minimal effort. Using this procedure, the patient is easily displaced laterally with minimal effort for example, from a bed to a stretcher or a stretcher to an operating table or any combination thereof. When the patient is moved to a desired location, the compressed air pressure may be brought to substantially zero or very low so that the bottom chamber is substantially flat or un-inflated.

The subject pad is light, flexible and easily stored. It is fabricated from nonwoven material and is intended to be single use disposable. This reduces the risk of infection and avoids the cost and time required for cleaning. Because the device performs two functions that presently require separate devices and air blowers, it saves space and reduces both costs and complexity in the operating room. The same heater pad can also be used after a patient leaves the operating room but still requires warming to maintain body temperature. It can also be utilized to facilitate transfer of the patient to another bed, stretcher or table.

A blower is appointed to be utilized with the pad to provide heated/cooled air and ambient air to the first and second interlocking chambers, respectively. Generally, the blower includes a main body housing removably attached to at least one hose which in turn includes an attachment fixture that is appointed to be attached to the mating attachments 23 and 33 of the first and second interlocking chambers inlets 23, 33, respectively. The hose allows the blower to supply air to both the first and second interlocking chambers when needed (such as during heated/cooled air delivery via the top chamber, and lateral transfer via the bottom chamber).

Generally, the blower includes low and high air regulator controls as well as heater/cool air controls and ambient air controls. Advantageously, the blower performs two functions in a single unit device, thus saving space and reducing costs in the operating room.

Figure 2:
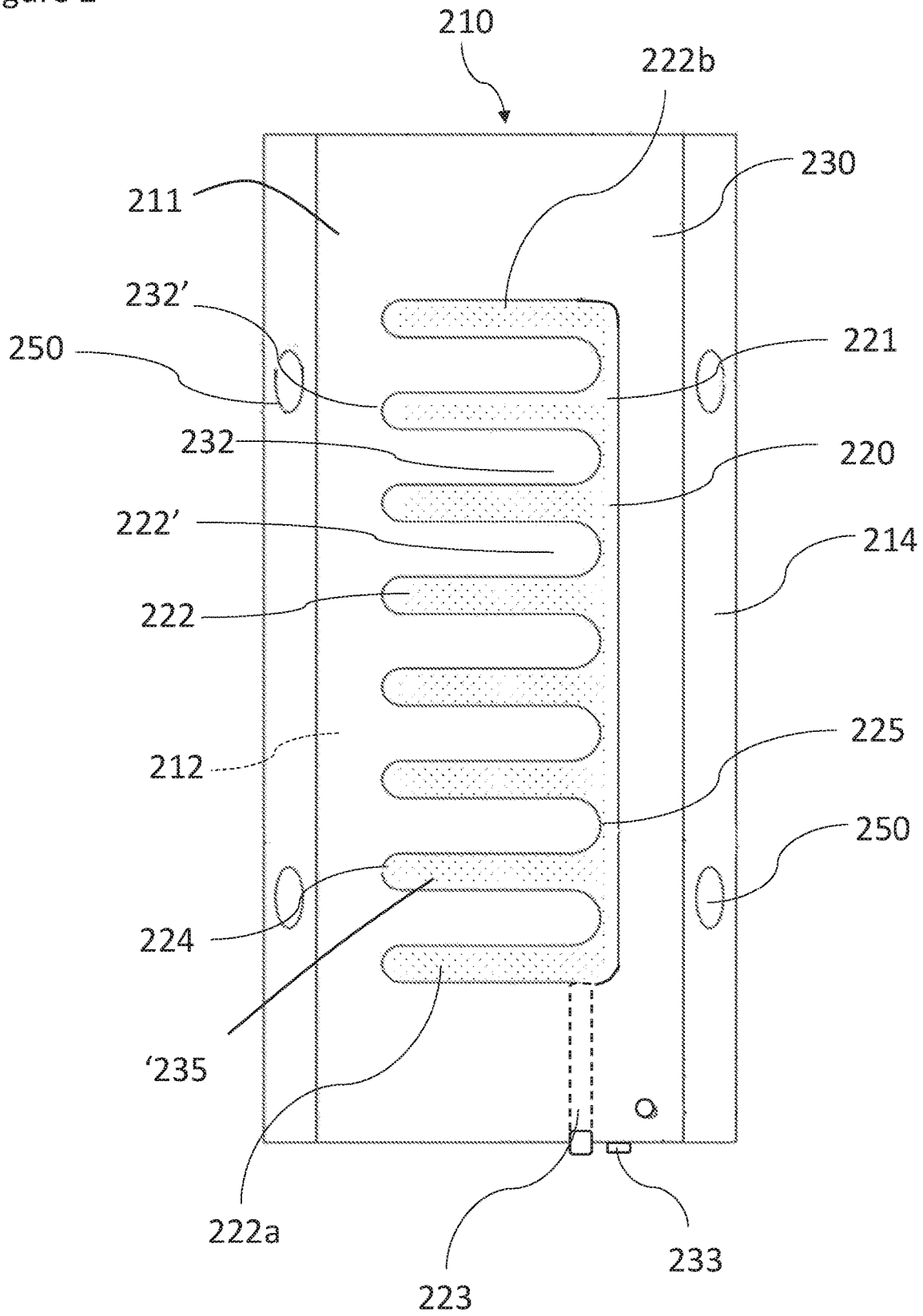
FIG. 2 illustrates a top view of another embodiment of the subject patient lifter/heater.

FIG. 2 illustrates a top view of another embodiment of the subject patient lifter/heater. Mattress or pad 210 is generally a thin flexible matt having a top surface 211 and a bottom surface 212. These top and bottom surfaces 211, 212 are comprised of first and second interlocking chambers 220 and 230, preferably formed when two layers of PVC, polyethylene or another plastic material are selectively fused together. Handles 250 are integrated into mattress or pad 210 by formation of apertures on both sides 214. First interlocking chamber 220 is formed as a comb-type structure having main spine 221 with a proximal prong 222*a* and a distal prong 222*b*, separated by a plurality of prongs 222*a*+n with valleys 222', forming a continuous chamber. An inlet 223 is provided near proximal prong 222*a* for heated air entry into first interlocking chamber 220. In the embodiment shown, the top surface of first interlocking chamber 220 includes top surface apertures or holes '235, so that the heated air exits from the chamber through apertures or holes '235 and circulates around the patient to maintain body temperature. Alternatively, first interlocking chamber 220 does not include any apertures or holes for air escape but instead has a smooth, uninterrupted top surface and the patient's body temperature is maintained by direct transfer of heat from the warmed top surface. Each prong 222 includes an arched convex end 224 linearly connected to an arched concave end 225. Second interlocking chamber 230 preferably entirely surrounds the first interlocking chamber 220 and includes a mirror comb-type structure having oppositely arranged prongs 232 separated by valleys 232' matingly laterally fused with first interlocking chamber 220. Second interlocking chamber 230 includes an inlet 233 for passing ambient air into the chamber 230 from a blower unit. Second interlocking chamber 230 includes a plurality of holes or apertures located on the bottom surface 212 for providing air release through the holes or apertures for airlifting the pad 210 for patient lifting.

Having thus described the invention in rather full detail, it will be understood that such detail need not be strictly adhered to, but that additional changes and modifications may suggest themselves to one skilled in the art. The first section of the patient lifter can be pulsed from small pressure to a slightly larger pressure with a preselected pulse frequency, while the second chamber is maintained at a small pressure. With this arrangement, the patient lifter functions as an alternating pressure pad, redistributing points of contact pressure extant between the top surface of the pad and body portions of a patient resting thereon to thereby avoid pressure sores and decubiti. The first chamber may have a filter integrated within the inlet. However, in an alternative embodiment, the filter may be formed or integrated within the apertures of the first chamber. In this manner, a filtration sheet is preferably bonded behind the apertures of the top chamber so that air is filtered directly and immediately before contacting the patient. Such modifications are considered to fall within the scope of the invention as defined by the subjoined claims.

What is claimed is:

1. A patient lifter with interlocking chambers for intraoperative controlled temperature air delivery, comprising: a. an air-inflated pad having a top surface and a bottom surface formed by way of a first interlocking chamber and a second interlocking chamber laterally fused together; b. said first interlocking chamber having a main spine with two or more prongs alternately separated by valleys and arranged on said pad so that said first interlocking chamber is spaced apart from edges of the pad; c. said second interlocking chamber substantially entirely laterally surrounding said first interlocking chamber and having two or more opposing prongs, the opposing prongs of the second interlocking chamber being separated by valleys matingly laterally fused side by side and not overlapping with the prongs of said first interlocking chamber alternatively separated by opposing valleys; d. said first interlocking chamber having an inlet appointed to be supplied with a regulated controlled pressure and controlled temperature heated or cooled air; e. said second interlocking chamber having a plurality of air venting apertures in said bottom surface of said air-inflated pad; f. said second interlocking chamber having an inlet appointed to be supplied with ambient air at a regulated, controlled pressure to facilitate lifting and lateral displacement during patient transfer; g. said lifter being configured as a single layer construct in which two independent interlocking chambers produced by controlled welding of two plastic layers form a thin, flexible matt that is disposable for single use; whereby heated air or cooled air is circulated through said first interlocking chamber, and formation of an air cushion from said second interlocking chamber facilitates lateral translation on a flat or irregular surface and reduces stress on both patient and hospital personnel.

2. A patient lifter as recited by claim 1, wherein said each of said first and said second interlocking chambers is laterally fused so that said first and said each of second interlocking chambers make up a portion of said top and said bottom surface of said air inflated pad.

3. A patient lifter as recited by claim 1, comprising handles.

4. A patient lifter as recited by claim 1, wherein said air-inflated pad is constructed of two-layer polyvinyl chloride (P.V.C.), polyethylene or another suitable plastic.

5. A patient lifter as recited by claim 1, wherein said first interlocking chamber includes apertures or holes for air escape.

6. A patient lifter as recited by claim 1, wherein said first interlocking chamber does not include any apertures or holes for air escape on said top surface of said air-inflated pad.

7. A patient lifter as recited by claim 4, wherein said first interlocking chamber may or may not include apertures or holes for air escape on said top surface of said air-inflated pad.

8. A patient lifter as recited by claim 1, wherein said inlet of said second interlocking chamber comprises mating attachment means and wherein said mating attachment means may comprise a filter adapted to filter said regulated, controlled pressure air to remove bacteria.

9. A patient lifter as recited by claim 1, wherein said first interlocking chamber is a single continuous chamber free from springs or barriers therein.

10. A patient lifter as recited by claim 1 comprising a single blower/motor with variable air pressure output and a heater that can be actuated to produce increased pressure/volume air flow with or without heat for delivery to said first interlocking chamber during patient transfer and decreased pressure with heated or cooled air in said first interlocking chamber to release warm or cooled air to maintain correct patient temperature.

11. A patient lifter as recited by claim 1, wherein said second interlocking chamber is a single continuous chamber free from springs or barriers therein.

12. A patient lifter as recited by claim 1, wherein said pad is fabricated from a thin, flexible disposable material for single use.

13. A patient lifter with an intraoperative controlled temperature air delivery system as recited by claim 1, wherein said top surface has a substantially smooth, uninterrupted configuration when the first chamber is not inflated.

14. A patient lifter with an intraoperative controlled temperature air delivery system as recited by claim 1, wherein said air-inflated pad is constructed of two-layer polyvinyl chloride (P.V.C.) or polyethylene having a thickness of at least eight mils.

* * * * *